US007481323B2

(12) United States Patent
Fisher

(10) Patent No.: US 7,481,323 B2
(45) Date of Patent: Jan. 27, 2009

(54) MULTI PURPOSE DOOR RACK

(76) Inventor: Roy Fisher, 952 N. Butte St., Willows, CA (US) 95988

( * ) Notice: Subject to any disclaimer, the term of this patent is extended or adjusted under 35 U.S.C. 154(b) by 395 days.

(21) Appl. No.: 11/200,057

(22) Filed: Aug. 10, 2005

(65) Prior Publication Data

US 2007/0034585 A1 Feb. 15, 2007

(51) Int. Cl.
*A47B 43/00* (2006.01)

(52) U.S. Cl. ..... 211/189; 211/207; 211/196

(58) Field of Classification Search ..... 211/70, 211/78, 189, 163, 207, 168, 107, 205, 196, 211/172, 197, 85.24; 118/500
See application file for complete search history.

(56) References Cited

U.S. PATENT DOCUMENTS

| | | | | | |
|---|---|---|---|---|---|
| 452,957 | A * | 5/1891 | Staunton | 40/497 |
| 928,292 | A * | 7/1909 | Walsh | 211/96 |
| 1,049,886 | A * | 1/1913 | Manson | 40/497 |
| 3,195,736 | A * | 7/1965 | Bomar, Jr. | 211/163 |
| 3,923,277 | A * | 12/1975 | Perrault et al. | 248/49 |
| 3,924,749 | A * | 12/1975 | Weston | 211/4 |
| 3,960,273 | A * | 6/1976 | Weston | 211/4 |
| 4,807,837 | A * | 2/1989 | Gawlik et al. | 248/125.8 |
| 4,895,261 | A * | 1/1990 | Yacobian | 211/196 |
| 5,090,648 | A | 2/1992 | Wood | |
| 5,164,011 | A | 11/1992 | Ray | |
| 5,503,278 | A | 4/1996 | Ishmael | |
| 5,771,050 | A * | 6/1998 | Gielen | 347/19 |
| 5,785,184 | A * | 7/1998 | Metselaar | 211/4 |
| 6,286,692 | B1 | 9/2001 | Hemping | |
| 6,338,758 | B1 | 1/2002 | Curran | |
| 6,471,076 | B1 * | 10/2002 | Chen | 211/70.6 |
| 6,595,377 | B1 * | 7/2003 | Hetu | 211/85.23 |
| 6,702,130 | B1 | 3/2004 | Carlisle | |
| 7,144,610 | B1 * | 12/2006 | Estes et al. | 428/19 |
| 2001/0008223 | A1 * | 7/2001 | Accatino | 211/169 |
| 2003/0015486 | A1 * | 1/2003 | Chen | 211/70 |
| 2006/0131249 | A1 * | 6/2006 | Kostigian | 211/45 |
| 2006/0175275 | A1 * | 8/2006 | Israel et al. | 211/169 |

* cited by examiner

*Primary Examiner*—Jennifer E. Novosad
(74) *Attorney, Agent, or Firm*—Cantor Colburn LLP

(57) ABSTRACT

A rack for hingedly mounting at least one door has a lower mounting plate and an upper mounting plate which are jointed by a central, telescoping support shaft. A plurality of mounting apertures are formed, equally distanced from the center of each of the upper and lower mounting plates which receive the pins of upper and lower attachment brackets which are attached to the upper and lower surface of each door to be mounted. When mounted, each door may be pivoted about the upper and lower attachment brackets so it may be painted on each of its two sides without interfering with any other door mounted on the rack. The rack may be adjusted to receive over height doors, as well as standard doors.

16 Claims, 6 Drawing Sheets

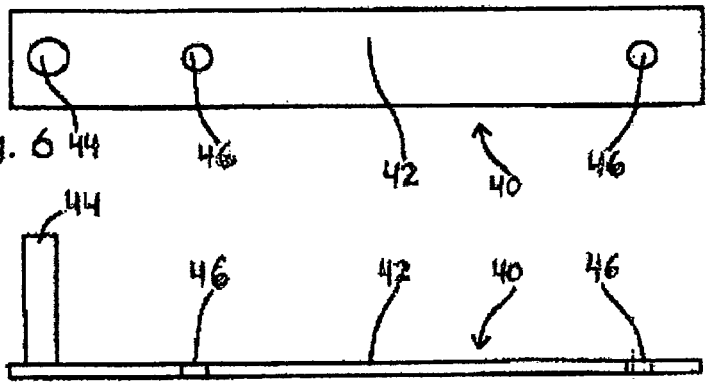
Fig. 6
Fig. 7
Fig. 8
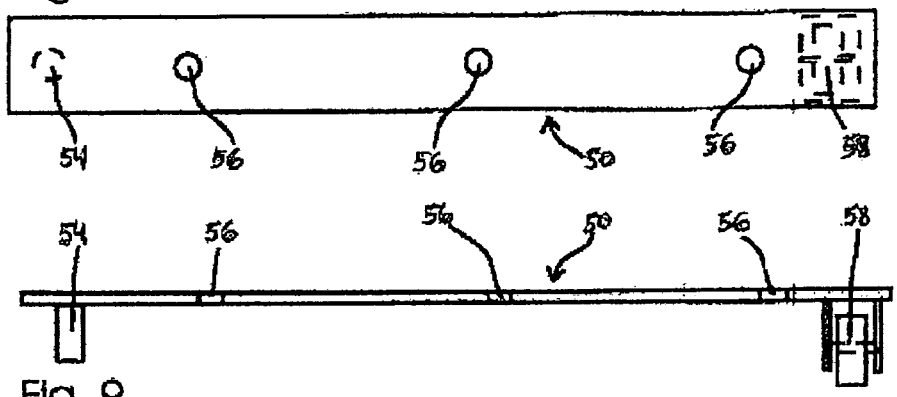
Fig. 9

MULTI PURPOSE DOOR RACK

BACKGROUND OF THE INVENTION

1. Field of the Invention

The present invention relates to devices to facilitate the painting of doors prior to installation into the door frame. More particularly, the invention comprises a rack for hingedly mounting a plurality of doors such that each door may be easily painted on both sides without having to handle the doors.

2. Description of the Prior Art

Painters have desired a convenient method for painting doors in a central location which requires a minimal amount of handling and space.

In U.S. Pat. No. 6,702,130, issued on Mar. 9, 2004, James D. Carlisle discloses a DOOR PAINTING RACK in which a plurality of doors may be mounted on the rack such that each door may be pivoted around a central axis of the each door. As opposed to the present invention, in which each door is hingedly mounted about a central pylon, Carlisle's rack requires an upper and lower extension from a center pylon for each door mounted to the rack.

U.S. Pat. No. 6,338,758, issued to William F. Curran on Jan. 15, 2002, discloses a MULTIPLE OBJECT PAINT RACK SYSTEM wherein a number of objects, such as doors, may be mounted, along a single axis, for painting. By contrast, the present invention mounts doors around a central pylon such that they may be swung from side to side for painting both sides without interference from adjacent doors.

A DOOR DISPLAY DEVICE is disclosed by David L. Ishmael in U.S. Pat. No. 5,503,278, issued on Apr. 2, 1996. In Ishmael's device, each door is mounted within a rectangular support, which is, in turn, pivotally mounted to a vertical support for pivotal movement about the vertical support. By contrast, in the present invention the doors are directly mounted to the central, vertical pylon.

U.S. Pat. No. 5,164,011, issued on Nov. 17, 1992, to David D. Ray, discloses a DOOR PAINTING FIXTURE, while U.S. Pat. No. 5,090,648, issued to William R. Wood, III, on Feb. 15, 1992 discloses a STAND ASSEMBLY. In both Ray and Wood, the racks are designed to hold a single door which is mounted along a central vertical axis such that the door may be pivoted about that axis for painting. By contrast, the present invention mounts a plurality of doors about a central, vertical pylon such that each door may be swung, hingedly, for painting of the two sides.

None of the above inventions and patents, taken either singly or in combination, is seen to describe the instant invention as claimed.

SUMMARY OF THE INVENTION

In the field of painting, as in residential or commercial buildings, the painting of doors is a time consuming job when performed in place, often requiring brush painting rather than spray painting. It is therefore, desirable to be able to paint doors, in quantity, at a single location. Painting in a single location provides other obstacles. Moving doors from place to place as they are painted, then left to dry typically ties up a considerable amount of space, requires handling of the freshly painted doors, etc.

The present invention provides a rack for easily mounting a plurality of doors about a central, vertical pylon such that each door may be positioned for painting on both sides by merely swinging each door from side to side about the central pylon. Arrangement of the doors around the pylon allows each door to be swung from side to side without interfering with the adjacent doors.

Accordingly, it is a principal object of the invention to provide a Multi Purpose Door Rack which is capable of pivotally holding one or more door(s) simultaneously for painting of both sides of the door(s).

It is another object of the invention to provide a Multi Purpose Door Rack which covers only a minimal portion of the top and bottom of each door, thereby allowing the painting of a maximum amount of the surface area of each door.

Yet another object of the invention is to provide a Multi Purpose Door Rack which can hold a plurality of door in a minimal amount of space.

Still another object of the invention is to provide a Multi Purpose Door Rack which is capable simultaneously holding doors of varying widths.

Another object of the invention is to provide a Multi Purpose Door Rack which is capable of simultaneously holding doors of varying heights.

It is a further object of the invention to provide a Multi Purpose Door Rack to which the door may be mounted with a minimal amount of labor involved.

Still another object of the invention is to provide a Multi Purpose Door Rack which is stable and safe, whether a single door or a plurality of doors are mounted thereto.

An additional object of the invention is to provide a Multi Purpose Door Rack which is easily assembled/disassembled for transportation from job to job.

It is again an object of the invention to provide a Multi Purpose Door Rack which may be easily moved about a job site.

Yet another object of the invention is to provide a Multi Purpose Door rack which is economical to produce and maintain.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 6 is a top view of an upper pivot arm assembly of the rack of the present invention.

FIG. 7 is a front view of an upper pivot arm assembly of the rack of the present invention.

FIG. 8 is a top view of a lower pivot arm assembly of the rack of the present invention.

FIG. 9 is a front view of a lower pivot arm assembly of the rack of the present invention.

DETAILED DESCRIPTION OF THE PREFERRED EMBODIMENTS

Figure 1:
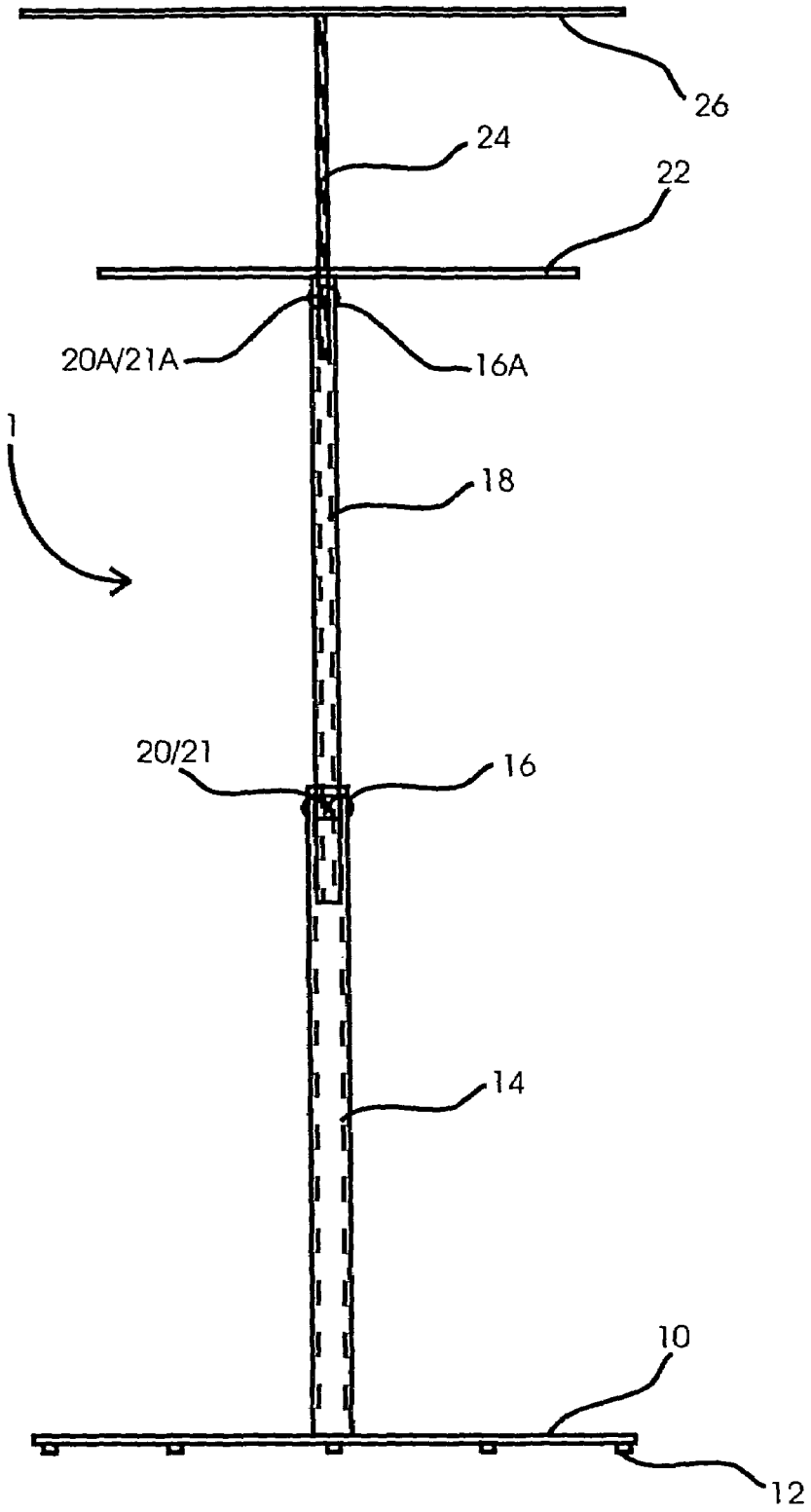
FIG. 1 is a front view of the rack of the present invention in its extended, in use configuration.
Figure 2:
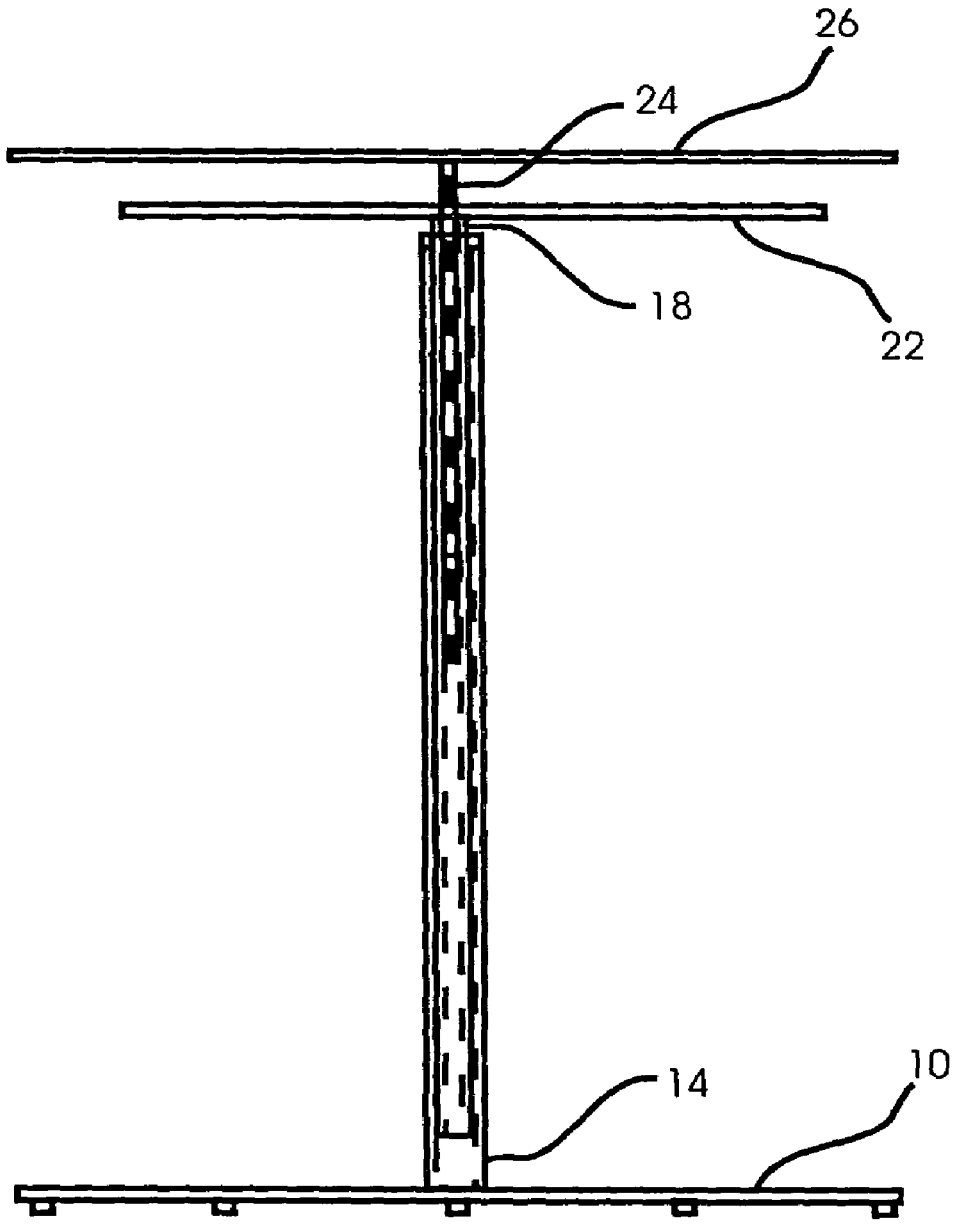
FIG. 2 is a front view of the rack of the present invention in its reduced configuration.

Referring first to FIGS. 1 (extended) and 2 (reduced), the door rack 1, of the present invention consists of a lower pivot plate 10 having a plurality of vertical risers 12 attached to the lower surface thereof, the risers 12 being intended to raise the lower pivot plate 10 away form a floor surface. The lower pivot plate 10 is typically of a flat, metal plate construction, although it would be evident that other, durable materials could be used without departing from the spirit of the invention. The risers 12 may, likewise, be of a variety of durable materials, and may be adapted to either render the rack 1 stationary or movable (e.g. lockable casters). While, in theory, three risers 12 are the minimum required for stability, it is preferable to have more. In the present invention, at least eight risers 12 are preferred. Lower pivot plate 10 is typically round in shape, but it would be evident that it could be of a differing shape without departing from the spirit of the invention.

Rising normal to and attached, at a proximal end, to the center of the upper surface of the lower pivot plate 10 is a hollow lower support shaft 14. Proximate its distal end, a pair of opposing apertures 16 are formed through the walls of the lower support shaft 14.

An upper support shaft 18, dimensioned to slidably, yet snugly, fit within the interior of the lower support shaft 14 at its distal end, telescopingly extends from the distal end of the lower support shaft 16. At a proximal end of the upper support shaft 18, apertures are formed in the opposing walls of the upper support shaft 18 with a spring loaded catch mechanism 20 located within the upper support shaft 18 extending through the apertures. The catch mechanism 20 is adapted to releaseably engage the apertures 16 formed in the distal end of the lower support shaft 14 to facilitate locking the upper support shaft 18 in the extended position and release it to be returned to a stored position within lower support shaft 14. The catch mechanism 20 could be replaced with a nut and bolt 21 with equal effectiveness. Like the lower support shaft 14, the upper support shaft 18 has a pair of opposing apertures 16A formed proximate it distal end. An upper pivot plate 22 is attached normal to and centered on the distal end of the upper support shaft 18. An aperture is formed in the center of the upper pivot plate 22 allowing the hollow of the interior of the upper support shaft 18 to continue through the upper pivot plate 22, as will be further explained hereinbelow. Like the lower pivot plate 10, the upper pivot plate 22 is typically round and of a metal plate construction, although it would, again, be evident that it could be of a differing shape without departing from the spirit of the invention.

An extension shaft 24, dimensioned to slidably, yet snugly, fit within the interior of the upper support shaft 18 at its distal end, telescopingly extends from the distal end of the upper support shaft 18 and through the upper pivot plate 22. Like the upper support shaft 18, at a proximal end of the extension shaft 24, apertures are formed in the opposing walls of the extension shaft 24 with a spring loaded catch mechanism 20A or nut and bolt 21A located within the extension shaft 24 extending through the apertures. Again, the catch mechanism 20A or nut and bolt 21A is adapted to releaseably engage the apertures 16A formed in the distal end of the upper support shaft 18 to facilitate alternately locking the extension shaft 24 in the extended position and releasing it to be returned to a stored position within upper support shaft 18. An extension pivot plate 26 is attached normal to and centered on the distal end of the extension shaft 24. Again, the extension pivot plate 26 is typically round and of a metal plate construction, although it would, again, be evident that it could be of a differing shape without departing from the spirit of the invention.

The attachment of the lower support shaft 14 to the lower attachment plate 10, upper support shaft 18 to upper attachment plate 22 and extension support shaft 24 to extension attachment plate 26 is preferably by a removable means, such as, but not limited to, nut and bolt, which would allow detachment for shipping and/or storage in a flat configuration, while also allowing storage in a reduced, telescoping mode. Likewise, since the extension shaft 24 and extension pivot plate 26 may or may not be used, the extension support shaft 24 could be bolted to the upper surface of the upper pivot plate 22 rather than telescoping into the upper support shaft 18, without departing from the spirit of the present invention. It would be evident that removable methods of attachment would require that attachment flange be attached to the either the attachment plates 20, 22 and 24 or the lower 14, upper 18 or extension 24 support shafts. It would be evident to one of ordinary skill in the art, however, that other attachments, such as, but not limited to, welding could be used without departing from the spirit of the present invention.

In order to prevent rotation of one within the other, the lower support shaft 14, upper support shaft 18 and extension shaft 24 are typically polygonic in cross section, although it would be evident that they could be elliptical or round without departing from the spirit of the invention.

Figure 5:
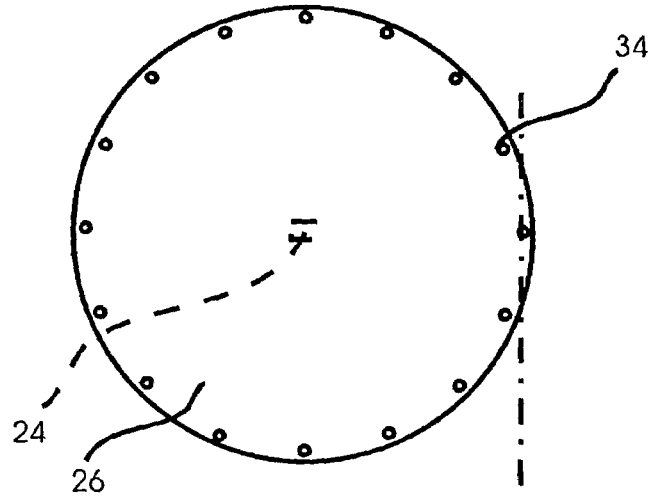
FIG. 5 is a top view of the extension pivot plate of the rack of the present invention.
Figure 4:
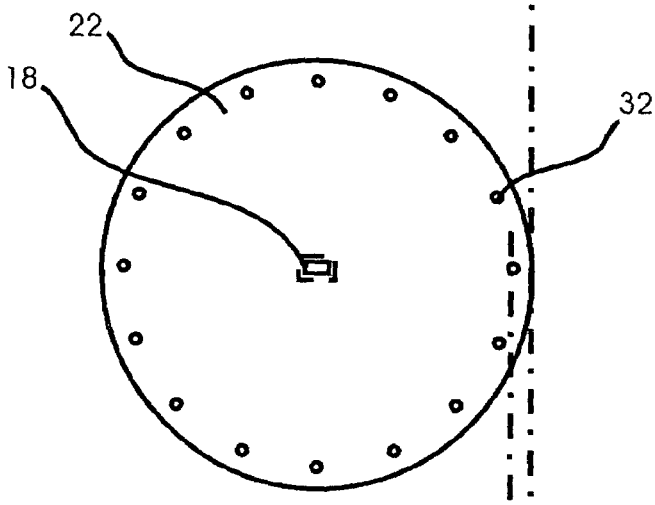
FIG. 4 is a top view of the upper pivot plate of the rack of the present invention.
Figure 3:
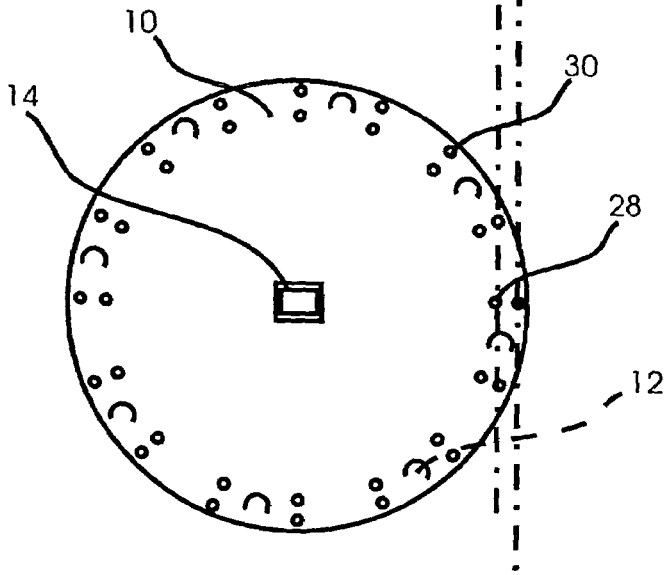
FIG. 3 is a top view of the lower pivot plate of the rack of the present invention.

Now turning to FIGS. 3 through 5, the lower pivot plate 10, upper pivot plate 22 and extension pivot plate 26 are shown in greater detail and relative to one another. At FIG. 3, a plurality of inner, lower pivot pin apertures 28 are formed through lower pivot plate 10, evenly spaced and at a first, given distance from the center of lower pivot plate 10. Likewise, a like number of outer, lower pivot pin apertures 30 are spaced along the radius line of each of the outer, lower pivot apertures 28 at a second, greater, given distance from the center of lower pivot plate 10.

At FIG. 4, a number of upper pivot pin apertures 32 equal to the number of outer, lower pivot pin apertures 28 and inner, lower pivot pin apertures 30 are formed in the upper pivot plate 22. The spacing of the upper pivot pin apertures 32 and radius of the circle formed by the upper pivot pin apertures 32, is such that an upper pivot pin aperture 32 is vertically aligned with each of the inner, lower pivot pin apertures 28. The radius of upper pivot plate 22 is, of course, greater than that of the circles formed by the upper pivot pin apertures 32, but less than that of the circle formed by the outer, lower pivot pin apertures 30, as described hereinbelow.

At FIG. 6, a number of extension pivot pin apertures 34 equal to the number of outer, lower pivot pin apertures 28 and inner, lower pivot pin apertures 30 are formed in the extension pivot plate 26. Again, the spacing of the extension pivot pin apertures 34 and radius of the circle formed by the extension pivot pin apertures 34, is such that an extension pivot pin aperture 34 is vertically aligned with each of the outer, lower pivot pin apertures 30. The radius of extension pivot plate 26 must, therefore be greater than that of the circle formed by the extension pin apertures 34, and typically the same as that of lower pivot plate 10.

The vertical alignment of the inner, lower pivot pin apertures 28 and upper pivot pin apertures 32 allow a plurality of doors of a given height to be mounted between each pair of inner, lower pivot pin apertures 28 and upper pivot pin apertures 32. Likewise, the vertical of the outer, lower pivot pin apertures 30 and extension pivot pin apertures 34 allow a plurality of doors of a greater height to mounted between each pair of outer, lower pivot pin apertures 30 and extension pivot pin apertures 34. The lesser diameter of the upper pivot plate 22 allows doors mounted between the lower pivot plate 10 and extension pivot plate 26 to clear the upper pivot plate 22.

Referring to FIGS. 6 and 7, the upper pivot arm assembly 40 consists of a flat metal upper pivot arm plate 42 having a length and having a width slightly less than the thickness of a typical door. At a first end of the upper surface of the upper pivot arm plate 42 an upper pivot pin 44 is mounted normal to and substantially centered on the width of the metal plate 42. The upper pivot pin 44 has a length which is in excess of that of the lower pivot pin 54, which will be discussed hereinbelow, and a diameter slightly less than the diameter of the upper 32 and extension pivot pin apertures 34. A plurality of apertures 46 are formed in the length of the upper pivot arm plate 42, one being proximate each end and substantially centered on the width. The apertures 46 are of a size suitable to receive a wood screw, typically a common dry wall screw. The apertures 46 may be countersunk on the upper surface of the upper pivot arm plate 42, although it is not necessary.

Now referring to FIGS. 8 and 9, the lower pivot arm assembly 50 consists of a flat metal lower pivot arm plate 52 similar to the upper pivot arm plate 42, although greater in length. A lower pivot pin 54 is rigidly attached on the lower surface of the lower pivot arm plate 52, normal to and centered on the width of the lower pivot arm plate 52 proximate a first end. A non-swivel caster 58 is rigidly attached on the lower surface of the pivot arm plate 52 proximate the second end thereof. A plurality of apertures 56 are formed through the lower pivot arm plate substantially along a centerline thereof. The apertures 56 may be countersunk into the lower surface of the lower pivot arm plate 52, but depending on the clearance between lower pivot arm plate 52 and lower pivot plate 10, it may be necessary for the aperture 56 closest to the lower pivot pin 54 to be countersunk in order to prevent the screw from dragging against the upper surface of the lower pivot plate 10. Again, the diameter of the apertures 56 are suitable to receive a wood screw, typically a common drywall screw.

It is, of course, desirable for all of the elements of the rack 1 to be of a durable material, with steel being the preferred material. It would be evident to one of ordinary skill in the art, however, that other materials, such as other metals or heavy duty polymers or poly-carbonates could be used with equal effectiveness without departing from the spirit of the present invention.

In use, the rack 1 is situated upright, sitting on the lower pivot plate 10. The upper support shaft 18 is extended such that the catch mechanism 20 engages the apertures 16 of the lower support shaft 14. The extension support shaft 24 may also be extended, likewise, as needed. An upper pivot arm assembly 40 is attached, with screws, to the upper surface of each door 60 to be mounted and a lower pivot assembly 50 to the lower surface of each door 60. The upper 40 and lower 50 assemblies are each mounted such that the pivot pins 44, 54 extend beyond the hinge side of the door 60 and are aligned with one another. After mounting the upper 40 and lower 50 pivot arm assemblies, a standard 6' 8" door 60 is lifted and the upper pivot pin 44 inserted into an upper pivot pin aperture 32 from below. The lower pivot pin 54 is then lowered into the corresponding lower pivot pin aperture 28. As stated previously, the upper pivot pin 44 is greater in length than the lower pivot pin 54 to allow the upper pivot pin 44 to remain in the upper pivot pin aperture 32 or extension pivot pin aperture 34 after the lower pivot pin 54 has been lowered fully into the lower pivot pin aperture 28/32.

Figure 10:
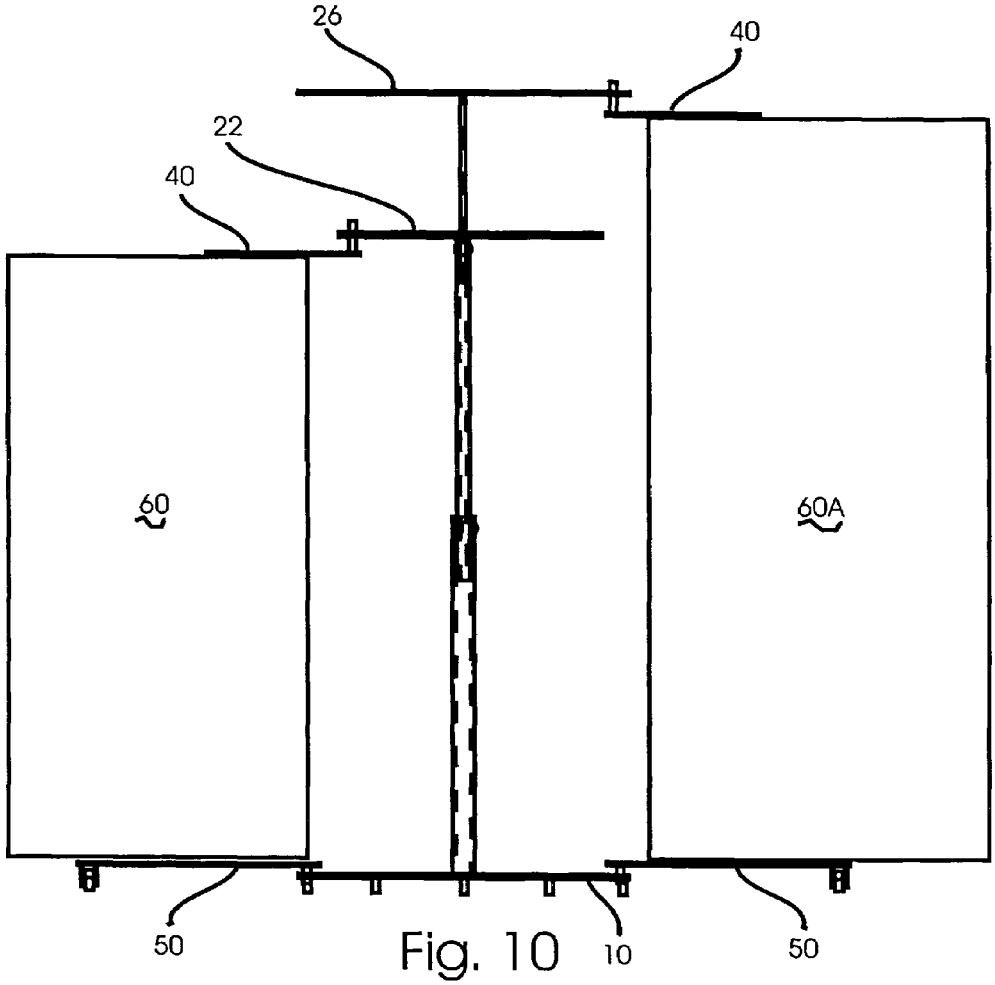
FIG. 10 is a front view of the rack of the present invention with doors of differing heights attached for painting.
Figure 11:
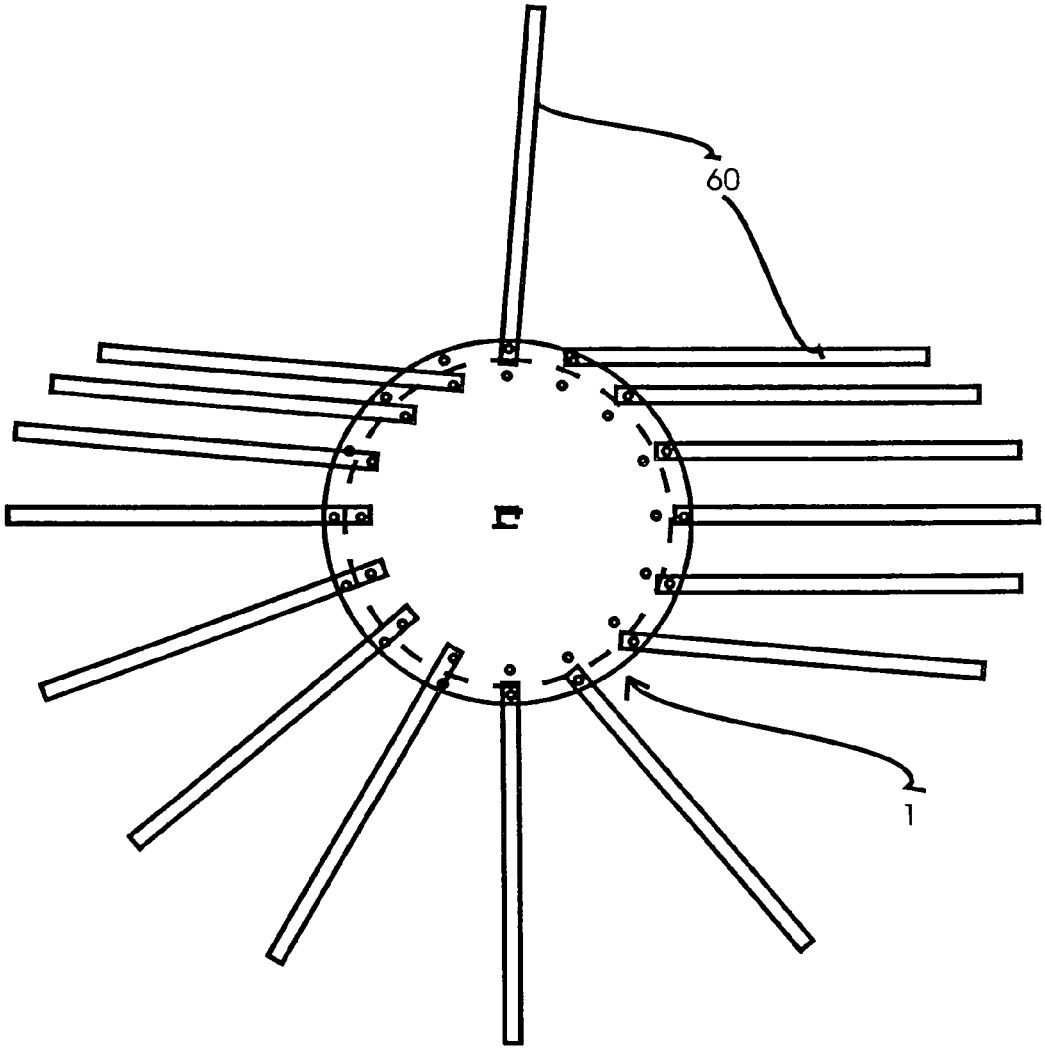
FIG. 11 is a top view of the rack of the present invention with a plurality of doors attached for painting.

At FIGS. 10 and 11, the rack 1 is illustrated with a plurality of doors 60 mounted for painting. As can be seen at FIG. 10, standard and over height doors 60*a* may be mounted at the same time, and as can be seen at FIG. 11, the doors 60 may be positioned such that any single door 60 can be fully exposed on both sides for painting, and the swung out of the way so the next door 60 may be painted. While the rack 1 is has been described as being able to hold a few as a single door, it would be evident to one of ordinary skill in the art that in the interest of safety, it is desirable that the doors 60 be evenly spaced around the perimeter of the rack 1 in order to make the rack 1 more stabile. Therefore the mounting of multiple doors 60 is preferable.

It is to be understood that the present invention is not limited to the embodiments described above, but encompasses any and all embodiments within the scope of the following claims.

What is claimed is:

1. A multi-purpose rack for mounting at least one door of a first height and at least one door of a second height, said second height being greater than said first height, in order to facilitate the process of painting said at least one door of a first height and said at least one door of a second height, said multi-purpose rack comprising:

a base which provides a stable support for said rack, mounting structure for mounting said at least one door of a first height on said rack, said mounting structure comprising two elements for supporting, respectively, opposite edges of said at least one door of a first height, support structure for supporting said mounting structure and spacing the at least two elements of said mounting structure apart from one another by a first distance, extension structure for enabling said rack, while mounting at least one door of a first height, to simultaneously mount at least one door of a second height, said second height being greater than said first height, wherein said extension structure has an upper member for supporting an upper edge of said at least one door of a second height, said upper member being capable of being positioned at a distance from one of said elements which is greater than said first distance between said elements, whereby said at least one door of a second height can be supported at said upper edge by said upper member and at a lower edge by said one of said elements of said mounting structure, and attachment structure for attaching an upper edge and a lower edge of each door to be mounted on said rack either to one of said two elements of said mountings structure or to said upper member.

2. A multi-purpose rack for mounting at least one door of a first height and at least one door of a seeond height, said seeond height being greater than said first height, in order to facilitate the process of painting said at least one door, as defined in claim 1, wherein:

said base comprises a substantially flat, lower mounting plate having a thickness and a diameter, and said base further comprises at least three risers mounted on a lower surface of said lower mounting plate at substantially equal distances around the perimeter thereof, said risers having a height such that said lower mounting plate is raised from a floor surface.

3. A multi-purpose rack for mounting at least one door of a first height and at least one door of a seeond height, said second height being greater than said first height, in order to facilitate the process of painting said at least one door, as defined in claim 2, wherein said mounting structure comprises:

a first plurality of apertures on said lower mounting plate for enabling at least one door of a first height to be secured thereto, said first plurality of apertures on said lower mounting plate being evenly spaced from one another and an upper mounting plate, said upper mounting pate having a thickness and a diameter, said upper mounting plate having a first plurality of mounting apertures formed therethrough, said first plurality of mounting apertures on said upper mounting plate being evenly spaced from one another, said first plurality of apertures on said lower mounting plate and said first plurality of apertures on said upper mounting plate each being located at a first distance from a center point of each of said lower mounting plate and said upper mounting plate, respectively, and said first plurality of mounting apertures in said upper mounting plate positioned so as to align with said first plurality of mounting apertures in said lower mounting plate.

4. A multi-purpose rack for mounting at least one door of a first height and at least one door of a second height, said second height being greater than said first height, in order to facilitate the process of painting said at least one door, as defined in claim 3, wherein said diameter of said upper mounting plate is less than said diameter of said lower mounting plate and a second plurality of mounting apertures are formed through said lower mounting plate at a second distance from said center point of said lower mounting plate, said second distance being greater than said first distance, each of said second plurality of mounting apertures lying along a radius line containing one of said first plurality of said mounting apertures of said lower mounting plate.

5. A multi-purpose rack for mounting at least one door of a first height and at least one door of a second height, said second height being greater than said first height, in order to facilitate the process of painting said at least one door, as defined in claim 4, wherein said support structure comprises a hollow lower support shaft attached at said center of and normal to an upper surface of said lower mounting plate, and a hollow upper support shaft having outside dimensions sufficiently smaller than the inside dimensions of said lower support shaft to allow said upper support shaft to slidably move within said lower support shaft, said upper support shaft attached at said center of and normal to a lower surface of said upper mounting plate, whereby said upper support shaft can telescopingly collapse into said lower support shaft to reduce the overall height of said multi-purpose rack for ease of transport and storage.

6. A multi-purpose rack for mounting at least one door of a first height and at least one door of a second height, said second height being greater than said first height, in order to facilitate the process of painting said at least one door, as defined in claim 5, wherein said lower support shaft and said upper support shaft are removably attached to said lower mounting plate and said upper mounting plate, respectively, thereby facilitating disassembly of said rack for transport/storage in a flat configuration.

7. A multi-purpose rack for mounting at least one door in order to facilitate the process of painting said at least one door, as defined in claim 5, wherein said lower support shaft and said upper support shaft each have a cross-section shaped to prevent relative rotation of said upper support shaft within said lower support shaft.

8. A multi-purpose rack for mounting at least one door in order to facilitate the process of painting said at least one door, as defined in claim 7, wherein said shape of said cross-section is polygonic.

9. A multi-purpose rack for mounting at least one door of a first height and at least one door of a second height, said second height being greater than said first height, in order to facilitate the process of painting said at least one door, as defined in claim 5, wherein said multi-purpose rack further comprises adjustment structure which enables the spacing between said upper mounting plate and said lower mounting plate to be adjusted between a storage configuration and an in-use configuration, said adjustment structure comprising:

a pair of opposing adjustment apertures formed in said lower support shaft proximate the upper end of a lower support shaft and a pair of opposing lower adjustment apertures formed in said upper support shaft proximate the lower end of said upper support shaft, said pair of adjustment apertures in said lower support shaft and said lower adjustment apertures in said upper support shaft being positioned such that all of said apertures are capable of being aligned, and an engagement device which releasably engages each of said adjustment apertures when they are aligned to releasably lock said lower support shaft and said upper support shaft into an extended relationship when engaged and to allow said upper support shaft to slide into said lower support shaft when not engaged.

10. A multi-purpose rack for mounting at least one door of a first height and at least one door of a second height, said second height being greater than said first height, in order to facilitate the process of painting said at least one door, as defined in claim 5, wherein said upper member of said extension structure comprises:

an extension mounting plate having a thickness and a diameter, said extension mounting plate having a plurality of mounting aperturesformed therethrough, evenly spaced at a given distance from a center point of said extension mounting plate, said given distance between said center point of said extension mounting plate and said mounting apertures in said extension mounting plate being substantially equal to said second distance which is between said center point of said lower mounting plate and said second plurality of mounting apertures in said lower mounting plate, such that said mounting apertures in said extension mounting plate align with said second plurality of mounting apertures in said lower mounting plate, an aperture formed at the center of said upper mounting plate, said aperture being dimensioned to coincide with the interior dimension of said upper support shaft, said extension structure further comprising a holiow extension support shaft having outside dimensions sufficiently smaller than the inside dimensions of said hollow upper support shaft to allow said extension support shaft to pass through said aperture in said upper mounting plate and to slide within said upper support shaft, said extension support shaft mounted at said center point of and normal to a lower surface of said extension mounting plate and being received within said hollow upper support shaft, adjustment structure which enables the spacing between said upper mounting plate and said extension mounting plate to be adjusted between a storage configuration and an in-use configuration, said adjustment structure comprising:

a pair of opposing adjustment apertures formed in said extension support shaft proximate a lower end of said extension support shaft, a pair of opposing upper adjustment apertures formed in said upper support shaft proximate said lower surface of said upper mounting plate, said pair of adjustment apertures in said extension support shaft and said upper adjustment apertures in said upper support shaft being positioned such that all of said adjustment apertures are capable of being aligned, and an engagement device which releasably engages each of said adjustment apertures when they are aligned to releasably lock said extension support shaft and said upper support shaft into an extended relationship when engaged and to allow said extension support shaft to slide into said upper support shaft when not engaged.

11. A multi-purpose rack for mounting at least one door of a first height and at least one door of a second height, said second height being greater than said first height, in order to facilitate the process of painting said at least one door, as defined in claim 2, wherein said attachment structure comprises:

at least one upper attachment assembly, each upper attachment assembly configured for attachment, respectively, to an upper surface of each door to be mounted on said rack, each said at least one upper attachment assembly comprising:

a substantially rectangular upper attachment assembly plate having a thickness, a length and a width, an upper attachment pin, having a diameter and a length, rigidly attached normal to and substantially centered upon the width of an upper surface of said upper attachment assembly plate proximate one end of said upper attachment assembly plate, and a plurality of apertures formed through said thickness of said upper attachment assembly plate, said plurality of apertures being substantially evenly spaced apart from one another, and lying substantially along a center line along said length of said upper attachment assembly plate, and at least one lower attachment assembly, each lower attachment assembly configured for attachment, respectively, to a lower surface of each door to be mounted on said rack, each said lower attachment assembly comprising:

a substantially rectangular lower attachment assembly plate having a thickness, a length and a width, a lower attachment pin, having a diameter and a length, rigidly attached normal to and substantially centered upon the width of a lower surface of said lower attachment assembly plate proximate a first end of said lower attachment assembly plate, said length of said lower attachment pin being less than said length of said upper attachment pin, said length of said lower attachment pin being less than the total of said thickness of said lower mounting plate and said height of said risers, a non-swivelling caster rigidly attached normal to and transverse a lower surface of said lower attachment assembly plate proximate a second end of said lower attachment assembly plate, the diameter of said caster being such that the distance from the bottom of said caster to said point of attachment of said caster to said lower attachment assembly plate is slightly greater than said total of said thickness of said lower mounting plate and said height of said risers, a plurality of apertures formed through said thickness of said lower attachment assembly plate, said plurality of apertures being substantially evenly spaced apart from one another, and lying substantially along a center line along said length of said lower attachment assembly plate.

12. A multi-purpose rack for mounting at least one door of a first height and at least one door of a second height, said second height being greater than said first height, in order to facilitate the process of painting said at least one door of a first height and said at least one door of a second height, said multi-purpose rack comprising:

a base which provides a stable support for said multi-purpose rack, said base comprising a substantially flat, lower mounting plate having a thickness and a diameter and having at least three risers mounted on a lower surface of said lower mounting plate at substantially equal distances around the perimeter thereof, said risers having a height such that said lower mounting plate is raised from a floor surface;

mounting structure for mounting said at least one door of a first height and said at least one door of a second height on said multi-purpose rack, said mounting structure comprising:

a first plurality of apertures on said lower mounting plate for enabling said at least one door of a first height to be secured thereto, said first plurality of apertures on said lower mounting plate being evenly spaced from one another, and an upper mounting plate, said upper mounting plate having a thickness and a diameter, said upper mounting plate having a first plurality of mounting apertures formed therethrough, said first plurality of mounting apertures on said upper mounting plate being evenly spaced from one another, said first plurality of apertures on said lower mounting plate and said first plurality of apertures on said upper mounting plate each being located at a first distance from a center point of each of said lower mounting plate and said upper mounting plate, respectively, and said first plurality of mounting apertures in said upper mounting plate positioned so as to align with said first plurality of mounting apertures in said lower mounting plate, wherein said diameter of said upper mounting plate is less than said diameter of said lower mounting plate, and a second plurality of mounting apertures are formed through said lower mounting plate at a second distance form said center point of said lower mounting plate, said second distance being greater than said first distance, each of said second plurality of mounting apertures lying along a radius line containing one of said first plurality of said mounting apertures of said lower mounting plate;

extension structure for adjusting said rack to enable it to mount at least one door of a second height, larger than said first height, while simultaneously mounting said at least one door of a first height, said extension structure comprising an extension mounting plate having a thickness and a diameter, said extension mounting plate having a plurality of mounting apertures formed therethrough, evenly spaced at a given distance form a center point of said extension mounting plate for enabling said at least one door of a second height to be secured thereto, said given distance between said center point of said extension mounting plate and said mounting apertures in said extension mounting plate being substantially equal to said second distance which is between said center point of said lower mounting plate and said second plurality of mounting apertures in said lower mounting plate, such that said mounting apertures in said extension mounting plate align with said second plurality of mounting apertures in said lower mounting plate, support structure for supporting said mounting structure and spacing the lower mounting plate, the upper mounting plate, and the extension mounting plate apart from one another, said support structure comprising:

a hollow lower support shaft attached at said center point of and normal to an upper surface of said lower mounting plate and a hollow upper support shaft having outside dimensions sufficiently smaller than the inside dimensions of said lower support shaft to allow said upper support shaft to slidably move within said lower support shaft, said upper support shaft attached at said center point of and normal to a lower surface of said upper mounting plate, whereby said upper support shaft can telescopingly collapse into said lower support shaft to reduce the overall height of said multi-purpose rack for ease of transport and storage;

an aperture formed at the center of said upper mounting plate, said aperture being dimensioned to coincide with the interior dimension of said upper support shaft, a hollow extension support shaft having outside dimensions sufficiently smaller than the inside dimensions of said hollow upper support shaft to allow said extension support shaft to pass through said aperture in said upper mounting plate and to slide within said upper support shaft, said extension support shaft attached at said center point of and normal to a lower surface of said extension mounting plate and being received within said hollow upper support shaft;

first adjustment structure which enables the spacing between said upper mounting plate and said lower mounting plate to be adjusted between a storage configuration and an in-use configuration, said first adjustment structure being capable of releasably locking said lower support shaft and said upper support shaft into an extended relationship when engaged and allowing said upper support shaft to slide into said lower support shaft when not engaged, second adjustment structure which enables the spacing between said upper mounting plate and said extension mounting plate to be adjusted between a storage configuration and an in-use configuration, said second adjustment structure being capable of releasably locking said extension support shaft and said upper support shaft into an extended relationship when engaged and to allow said extension support shaft to refract into said upper support shaft when not engaged; and attachment structure for attaching each end of each door to be mounted on said rack either to said lower mounting plate, said upper mounting plate, or said extension mounting plate, said attachment structure comprising:

at least one upper attachment assembly, each upper attachment assembly configured for attachment, respectively, to an upper surface of each door to be mounted on said rack, each said at least one upper attachment assembly comprising:

a substantially rectangular upper attachment assembly plate having a thickness, a length, and a width, an upper attachment pin, having a diameter and a length, rigidly attached normal to and substantially centered upon the width of an upper surface of said upper attachment assembly plate proximate one end of said upper attachment assembly plate, and a plurality of apertures formed through said thickness of said upper attachment assembly plate, said plurality of apertures being substantially evenly spaced apart from one another, and lying substantially along a center line along said length of said upper attachment assembly plate, and at least one lower attachment assembly, each lower attachment assembly configured for attachment, respectively, to a lower surface of each door to be mounted on said rack, each said lower attachment assembly comprising:

a substantially rectangular lower attachment assembly plate having a thickness, a length and a width, a lower attachment pin, having a diameter and a length, rigidly attached normal to and substantially centered upon the width of a lower surface of said lower attachment assembly plate proximate a first end of said lower attachment assembly plate, said length of said lower attachment pin being less than said length of said upper attachment pin, said length of said lower attachment pin being less than the total of said thickness of said lower mounting plate and said height of said risers, a non-swiveling caster rigidly attached normal to and transverse a lower surface of said lower attachment assembly plate proximate a second end of said lower attachment assembly plate, the diameter of said caster being such that the distance from the bottom of said caster to said point of attachment of said caster to said lower attachment assembly plate is slightly greater than said total of said thickness of said lower mounting plate and said height of said risers, a plurality of apertures formed through said thickness of said lower attachment assembly pate, said plurality of apertures being substantially evenly spaced apart from one another, and lying substantially along a center line along said length of said lower attachment assembly plate.

13. A method of attaching at least one door of a first height to said multi-purpose rack, as defined in claim 12, and using said rack, after said at least one door has been mounted, comprising the steps of:

situating said rack on a stable surface, with each of said risers in contact with said stable surface, and extending said upper support shaft from said lower support shaft and aligning said adjustment apertures formed in said lower support shaft and said lower adjustment apertures formed in said upper support shaft and engaging said first engagement device, attaching one of said upper attachment assemblies to the upper surface of each of said at least one door of a first height to be mounted on said rack such that said upper attachment pin extends away from said upper surface of said door and extends beyond one side edge of said door, attaching one of said lower attachment assemblies to the lower surface of each of said at least one door to be mounted on said rack such that said lower attachment pin and said caster extend away from said lower surface of said door and said lower attachment pin extends beyond the same said side edge of said door a distance equal to said extension of said upper attachment pin from aid edge of said door, lifting a first of said at least one door to a substantially vertical position and inserting said upper attachment pin into one of said upper mounting apertures formed in said upper mounting plate from below, lowering said lower attachment pin into the one of said lower mounting apertures formed in said lower attachment plate vertically corresponding to the one of said upper mounting apertures, the excess of said length of said upper attachment pin over said length of said lower attachment pin allowing said upper attachment pinto remain engaged in said upper mounting aperture, and said caster supporting the weight of said at least one door extending beyond said perimeter of said lower mounting plate, repeating the process of lifting an additional of said at least one door and of insertion of said upper attachment pin and said lower attachment pin, into a different of said upper mounting apertures and said lower mounting apertures, evenly spacing said doors around the perimeter of said rack until said rack is full or all of said doors are mounted, pivoting each of said at least one door about said upper attachment pin and said lower attachment pin to a position which is optimal for the painting of said door.

14. A method of attaching at least one door of a second height to said multi-purpose rack, as defined in claim 12, and using said rack after said doors have been mounted, comprising the steps of:

situating said rack on a stable surface, with each of said risers in firm contact with said stable surface, and extending said upper support shaft from said lower support shaft and engaging said first adjustment structure to lock said upper support shaft and said lower support shaft in an extended relationship, extending said extension support shaft from said upper support shaft and aligning said adjustment apertures formed in said upper support shaft and said upper adjustment aperture formed in said extension shaft and engaging said second engagement device.

attaching one of said upper attachment assemblies to the upper surface of each of at least one door of a second height, greater than said first height, to be mounted on said rack such that said upper attachment pin extends away from said upper surface of said door of a second height and extends beyond one side edge of said door of a second height, attaching one of said lower attachment assemblies to the lower surface of each of said at least one door of a second height to be mounted on said rack such that said lower attachment pin and said caster extend away from said lower surface of said door of a second height and said lower attachment pin extends beyond the same said side edge of said door of a second height a distance equal to said extension of said upper attachment pin from said edge of said door of a second height, lifting a first of said at least one door of a second height to a substantially vertical position and inserting said upper attachment pin into one of said extension mounting apertures formed in said extension mounting plate from below, lowering said lower attachment pin into the one of said lower mounting apertures formed in said lower attachment plate vertically corresponding to the one of said extension mounting apertures, whereby said length of said upper attachment pin exceeding said length of said lower attachment pin allows said upper attachment pin to remain engaged in said upper mounting aperture, and said caster supporting the weight of said at least one door of a second height extending beyond said perimeter of said lower mounting plate, repeating the process of lifting an additional of said at least one door of a second height and of insertion of said upper attachment pin and said lower attachment pin, into a different of said extension mounting apertures and said lower mounting apertures, evenly spacing said doors around the perimeter of said rack until said rack is full or all of said door of a second height are mounted, pivoting each of said at least one door of a second height about said upper attachment pin and said lower attachment pin to a position which is optimal for the painting of said door of a second height.

15. A method of attaching at least one door of a first height and at least one door of a second height, said second height being greater than said first height, to said rack, as defined in claim 12, and using said rack after said doors have been mounted comprising:

situating said rack on a stable surface, with each of said risers in contact with said stable surface, and extending said upper support shaft from said lower support shaft and engaging said first adjustment structure to lock said upper support shaft and said lower support shaft in an extended relationship, extending said extension support shaft from said upper support shaft and engaging said second adjustment structure to lock said upper support shaft and said extension shaft in an extended relationship, attaching one of said upper attachment assemblies to the upper surface of each of said at least one door of a first height and at least one door of a second height to be mounted on said rack such that said upper attachment pin extends away from said upper surface of said door and extends beyond one side edge of said door, attaching one of said lower attachment assemblies to the lower surface of each of said at least one door of a first height and said at least one door of a second height to be mounted on said rack such that said lower attachment pin and said caster extend away from said lower surface of said door and said lower attachment pin extends beyond the same said side edge of said door a distance equal to said extension of said upper attachment pin from said edge of said door, lifting a first of said at least one door of a first height to a substantially vertical position and inserting said upper attachment pin into one of said upper mounting apertures formed in said upper mounting plate from below, lowering said lower attachment pin into the one of said lower mounting apertures formed in said lower attachment plate vertically corresponding to the one of said upper mounting apertures, whereby the length of said upper attachment pin exceeding said length of said lower attachment pin allows said upper attachment pin to remain engaged in said upper mounting aperture, and said caster supporting the weight of said at least one door of a first height extending beyond said perimeter of said lower mounting plate, lifting a first of said at least one door of a second height to a substantially vertical position and inserting said upper attachment pin into one of said extension mounting apertures formed in said extension mounting plate from below, lowering said lower attachment pin into the one of said lower mounting apertures formed in said lower attachment plate vertically corresponding to the one of said extension mounting apertures, whereby the length of said upper attachment pin exceeding said length of said lower attachment pin allows said upper attachment pin to remain engaged in said extension mounting aperture, and said caster supporting the weight of said at least one over height door extending beyond said perimeter of said lower mounting plate, repeating the procedure of lifting an additional of said at least one door of a first height or door of a second height and of insertion of said upper attachment pin and said lower attachment pin, into a different of said upper mounting apertures or extension mounting apertures and said lower mounting apertures, evenly spacing said doors around the perimeter of said rack until said rack is full or all of said doors are mounted, pivoting each of said at least one door about said upper attachment pin and said lower attachment pin to a position which is optimal for the painting of said door.

16. A multi-purpose rack for mounting at least one door of a first height in order to facilitate the process of painting said at least one door, as defined in claim 12, wherein:

said first adjustment structure comprises:

a pair of opposing adjustment apertures formed in said lower support shaft proximate the upper end thereof and a pair of opposing lower adjustment apertures formed in said upper support shaft proximate the lower end of said upper support shaft, said pair of adjustment apertures in said lower support shaft and said lower adjustment apertures in said upper support shaft being positioned such that all of said apertures are capable of being aligned, and one from the group consisting of:

a bolt and a nut passing through said aligned adjustment apertures formed in said lower support shaft and said lower end of said upper support shaft, and a spring-loaded catch mechanism within said upper support shaft and extending through said pair of lower adjustment apertures formed in said upper support shaft, said spring-loaded catch mechanism releasably engaging said pair of adjustment apertures formed in said lower support shaft, a first engagement device which releasably engages each of said adjustment apertures in said first adjustment structure when they are aligned to releasably lock said lower support shaft and said upper support shaft into an extended relationship when engaged and to allow said upper support shaft to slide into said lower support shaft when not engaged said second adjustment structure comprises:

a pair of opposing adjustment apertures formed in said extension support shaft proximate a lower end of said extension support shaft, a pair of opposing upper adjustment apertures formed in said upper support shaft proximate said lower surface of said upper mounting plate, said pair of adjustment apertures in said extension support shaft and said upper adjustment apertures in said upper support shaft being positioned such that all of said adjustment apertures are capable of being aligned, and one from the group consisting of:

a bolt and a nut passing through said aligned adjustment apertures formed in said extension support shaft and said upper adjustment apertures formed in said upper support shaft, and a spring-loaded catch mechanism within said extension support shaft and extending through said pair of adjustment apertures formed in said extension support shaft, said spring-loaded catch mechanism releasably engaging said pair of upper adjustment apertures formed in said upper support shaft, a second engagement device which releasably engages each of said adjustment apertures in said second adjustment structure when they are aligned to releasably lock said extension support shaft and said upper support shaft into an extended relationship when engaged and to allow said extension support shaft to retract into said upper support shaft when not engaged.

* * * * *